United States Patent [19]

Walkup

[11] Patent Number: 4,990,095

[45] Date of Patent: Feb. 5, 1991

[54] ZERO SEPARATION FORCE CONNECTOR

[75] Inventor: William B. Walkup, Barrington, R.I.

[73] Assignee: Augat Inc., Mansfield, Mass.

[21] Appl. No.: 372,296

[22] Filed: Jun. 27, 1989

[51] Int. Cl.[5] ..... H01R 13/00

[52] U.S. Cl. ..... 439/152

[58] Field of Search ..... 439/152, 153, 180, 359, 439/364, 368

[56] References Cited

U.S. PATENT DOCUMENTS

| | | | |
|---|---|---|---|
| 1,711,397 | 4/1929 | Rumble | 439/152 |
| 2,445,588 | 7/1948 | Skeats | 439/152 |
| 2,736,870 | 2/1956 | Jur et al. | 439/152 |
| 3,209,302 | 9/1965 | Uberbacher | 439/153 |

*Primary Examiner*—Joseph H. McGlynn

*Attorney, Agent, or Firm*—Weingarten, Schurgin, Gagnebin & Hayes

[57] ABSTRACT

A zero separation force electrical connector which utilizes resilient energy developed and stored during mating to demate the mated contacts and separate the connector with zero separation force. In one embodiment, the contacts of first and second housing members are mated in combination to provide the stored resilient energy for subsequent demating of the contacts and the respective housing members with zero separation force. The first housing member includes male contacts with tapered ends and the second housing member includes female contacts with spring fingers. A securing mechanism is utilized to mate the first and second housing members in combination. During mating the tapered ends of the male contacts coact with corresponding spring fingers of the female contacts, biasing the fingers outwardly, to store resilient energy therein. Releasing the securing mechanism causes the resilient energy in the spring fingers to be exerted against the tapered ends of the male contacts to demate the contacts and separate the first and second housing members with zero separation force. In another embodiment, the electrical connector consists of a single housing member containing female contacts with spring fingers and a securing mechanism which is mated in combination with the male pin grid array of an electronic device such as a printed circuit board.

14 Claims, 3 Drawing Sheets

ZERO SEPARATION FORCE CONNECTOR

FIELD OF THE INVENTION

This invention relates to electrical connectors, and more particularly to electrical connectors which may be demated with zero separation force.

BACKGROUND OF THE INVENTION

Electrical connectors and pin grid arrays having large pluralities of contacts ar utilized to electrically interconnect printed circuit boards and other devices. The mechanical and electrical integrity of mated contacts is maintained by frictional forces exerted between the surfaces of corresponding contacts and/or sockets. To demate large pluralities of mated contacts, a considerable separation force may be required to overcome the combined frictional forces of the contacts.

Problems arise where the separation force required to separate or remove the connectors from the printed circuit boards or to demate mated contacts is such as to overstress the boards by bending or flexing thereof. Such stresses may result in broken connections, broken components and/or damaged circuit boards. One approach to these problems is to utilize expensive and cumbersome extracting devices, although such devices may still exert unnecessary stresses on the circuit boards, bend pins and/or overstress the plastic or ceramic housings of the connector.

Another approach is to limit the number of contacts contained in the electrical connectors. This approach is of limited utility in the present day due to technology requirements that mandate the use of large numbers of contacts.

SUMMARY OF THE INVENTION

To overcome the inherent limitations in prior art electrical connectors which require excessive separation forces to demate the mated contacts, the present invention is directed to a zero separation force electrical connector which utilizes resilient energy developed and stored during mating to demate the mated contacts and separate the connector with zero separation force. The present invention has particular utility for readily interconnecting and disconnecting small printed circuit boards with multiple mezzanine type interconnects. Large arrays of contacts can also be readily interconnected and disconnected, thereby facilitating the interconnection of a large number of circuit lines.

One embodiment of the zero separation force electrical connector according to the present invention includes first and second housing members having specially configured contacts disposed therein. The set of contacts in the first housing member have a tapered end. The set of contacts in the second housing member have spring fingers configured to coact with the tapered ends of the first set of contacts. The electrical connector also includes a securing means to latch and retain the first and second housing members in mated relation.

During mating of the housing members, the tapered ends of the first contacts coact with the spring fingers of the corresponding second contacts to bias the spring fingers outwardly, thereby developing and storing a resilient force in the spring fingers. Upon release of the securing means, the resilient force stored in the spring fingers acts against the tapered ends of the first contacts to demate the contacts and separate the first and second housing members with zero separation force.

Another embodiment of a zero separation force electrical connector is configured for mating with the male pin grid array of an electronic device such as a printed circuit board. The electrical connector includes a single housing member having a set of contacts with spring fingers configured to coact with the tapered ends of the male pin grid array of the electronic device. The electrical connector also includes a securing means to latch and retain the single housing member in mated relation with the electronic device. Upon release of the securing means, the resilient force stored in the spring fingers acts against the tapered ends of the male pin grid array to demate the contacts and separate the connector housing from the electronic device.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
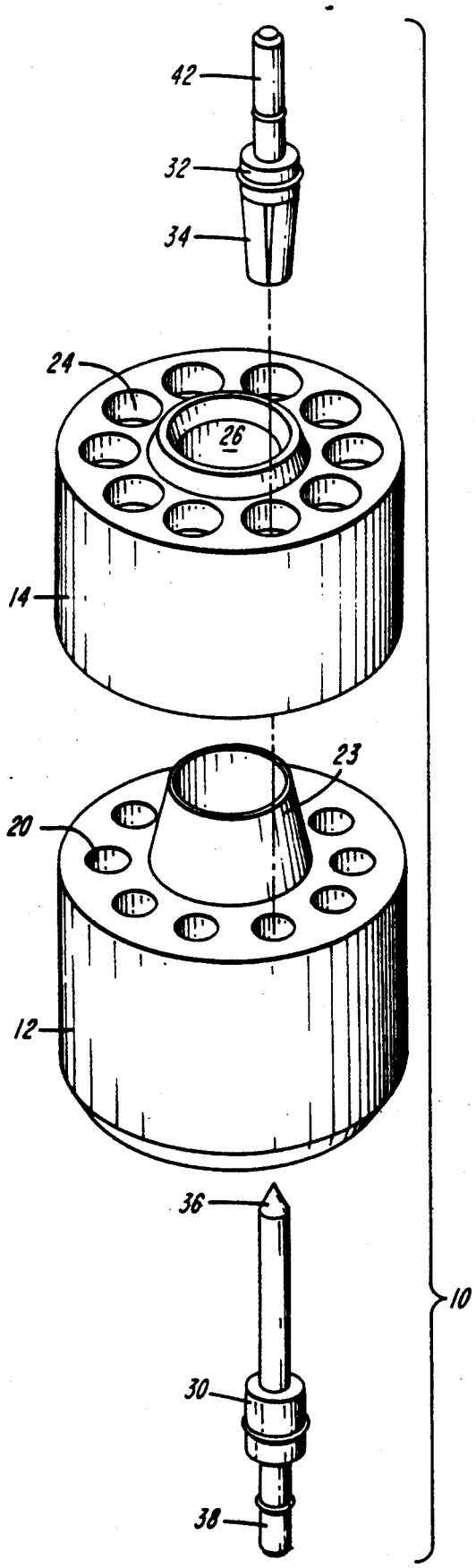
FIGS. 1, 1A are exploded perspective views of a zero separation force electrical connector according to the present invention.
Figure 1A:
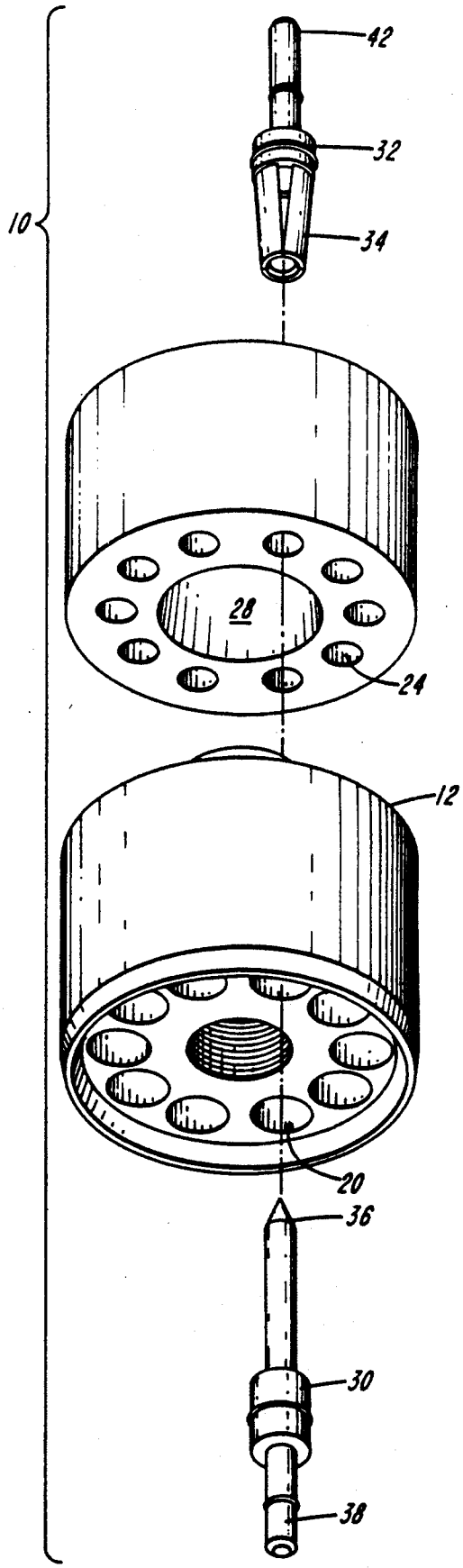

Referring now to the drawings wherein like reference numerals designate corresponding or similar elements throughout the several views, one embodiment of a zero separation force electrical connector 10 according to the present invention is exemplarily illustrated in FIGS. 1A, 1B. The electrical connector 10 comprises a first housing member 12 and a second housing member 14 having contacts disposed therein as described in further detail hereinbelow. The housing members 12, 14 may be formed by known techniques from a non-conducting material such as plastic or ceramic.

The first housing member 12 includes a plurality of contact cavities 20 and a means 22 for mating the first housing member 12 in combination with the second housing member 14. As exemplarily illustrated in the drawings, the mating means 22 comprises a threaded bore. The first housing member 12 may also include a shaped member 23 depending outwardly therefrom as illustrated.

The second housing member 14 includes a plurality of contact cavities 24 and a complementary means 26 for mating the first housing member 12 in combination with the second housing member 14. As exemplarily illustrated in the drawings, the complementary mating means 26 comprises a smooth bore. For those embodiments wherein the first housing member 12 includes a shaped depending member 23, the second housing member 14 includes a complementary shaped cavity 28 interfacing with the smooth bore 26.

The contact cavities 20 of the first housing member 12 are configured to receive a first plurality of contacts 30. As exemplarily illustrated, the first contacts 30 are male contacts which are inserted in the contact cavities 20 by any conventional method such as press fitting. Each male contact 30 includes a tapered end 36 and a contact end 38 configured for electrical interconnection with external circuitry (not shown). The male contacts 30 may be formed in various configurations such as generally cylindrical contacts or stamped contacts.

The contact cavities 24 of the second housing member 14 are configured to receive a second plurality of contacts 32. As exemplarily illustrated, the second contacts 32 are female contacts which are seated in the contact cavities 24. Each female contact 32 includes an end having spring fingers 34 and a contact end 42 configured for electrical interconnection with external circuitry (not shown). The female contacts 30 may be formed in various configurations corresponding to the male contacts 30.

For example, for the generally cylindrical male contacts 30 as illustrated in the drawings, the female contacts 32 would have a plurality of spring fingers 34 arranged about the axis of the contact. For stamped male contacts, the spring fingers of the female contacts would have a tuning fork configuration.

Figure 2:
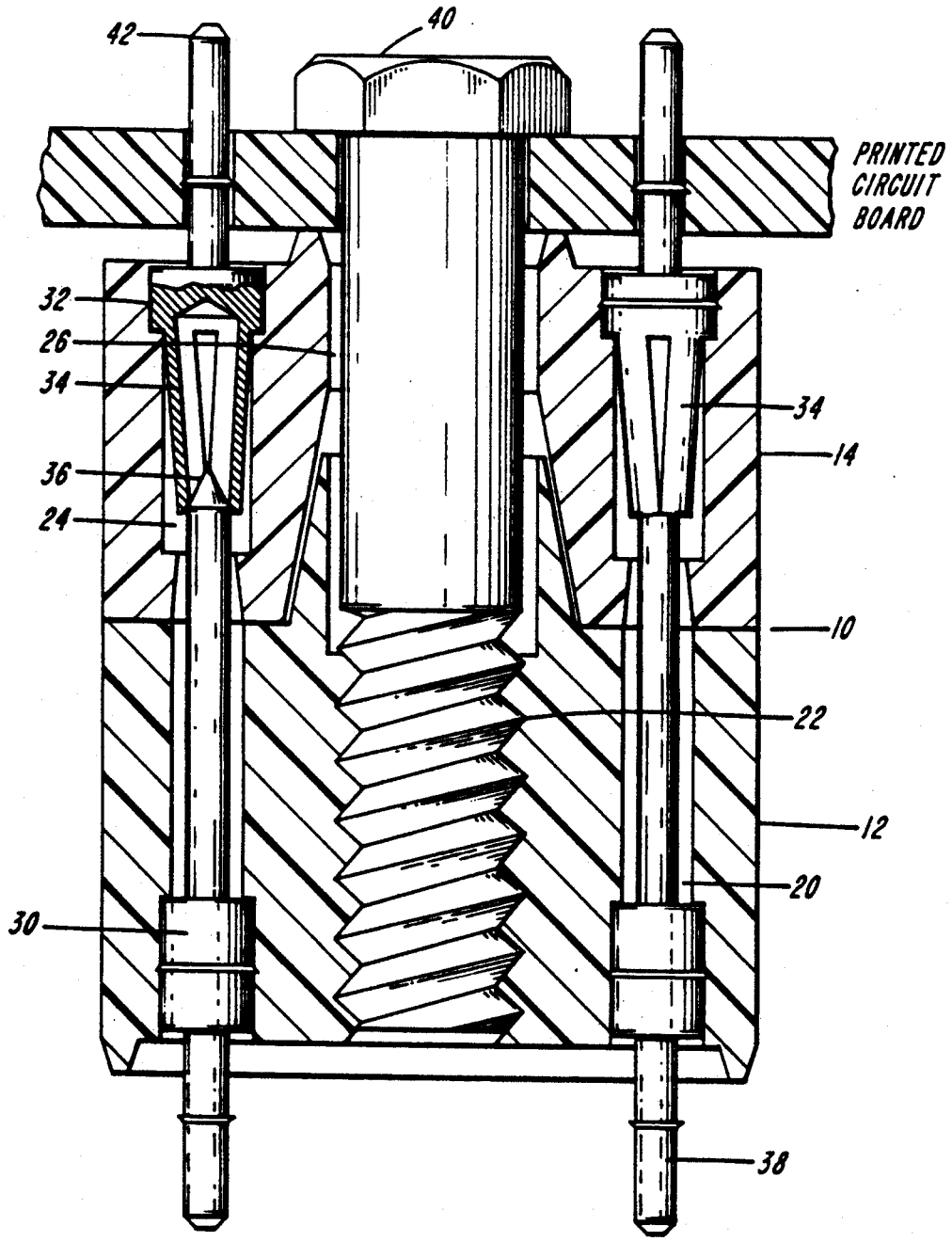
FIG. 2 is a cross-sectional view of a zero separation force electrical connector in the mated state.

A medial cross-sectional view of the electrical connector of FIG. 1 is depicted in FIG. 2. A securing means 40, in this embodiment a screw configured to be inserted through the smooth bore 26 and threaded into the threaded bore 22, is actuated to provide a force to mate the first and second housing members 12, 14 in combination to form the electrical connector 10. During mating, the shaped member 23 coacts with the complementary shaped cavity 28 to align the first and second housing members 12, 14 for mating.

The securing means 40 also provides the necessary force to cause the tapered ends 36 of the male contacts 30 to mechanically and electrically engage corresponding spring fingers 34 of the female contacts 32. The tapered ends 36 coact with the corresponding spring fingers 34 to bias the fingers 34 outwardly such that resilient energy is stored in the spring fingers 34 with the first and second housing members 12, 14 mated in combination to form the electrical connector 10.

Releasing the securing means 40 causes the resilient energy stored in the spring fingers 34 to be exerted against the corresponding tapered ends 36. This causes the male contacts 30 to be demated from corresponding female contacts 32 and the first and second housing members 12, 14 to be separated with zero separation force.

Another embodiment of a zero separation force electrical connector 10' according to the present invention is a derivation of the above-described electrical connector. The electrical connector 10' is configured for mating with a male pin grid array of an electronic device such as a printed circuit board. The pins of the male pin grid array have externally projecting tapered ends 36' as described hereinabove.

The electrical connector 10' includes a single housing member 14' having a plurality of contact cavities 24' and a complementary means 26' for mating the housing member 14' in combination with the electronic device. The complementary means 26' may be a smooth bore configured to receive a securing means 40' such as a screw which may be threaded into the electronic device for mating.

The contact cavities 24' are configured to receive a second plurality of contacts 32' as described hereinabove. The electrical connector 10' is mated in combination by inserting the screw 40' through the complementary means 26' into threaded engagement with a threaded inset of the electronic device. Releasing the securing means 40' causes the resilient energy stored in the spring fingers 34' to be exerted against the corresponding tapered ends 36' of the male pin grid array. This causes the pin grid array to be demated from corresponding female contacts 32' and the housing member 14' to be separated from the electronic device with zero separation force.

A variety of modifications and variations of the present invention are possible in light of the above teachings. For example, the securing means may be mechanical camming means associated with the first and second housing members or the housing member and the electronic device and operative to provide the mating force to mate the first and second housing members or the housing member and the electronic device in combination and to store potential biasing energy in the spring fingers. It is therefore to be understood that within the scope of the appended claims, the present invention may be practiced otherwise than as specifically described hereinabove.

What is claimed is:

1. A zero separation force electrical connector, comprising:

a first housing member having a plurality of contact cavities;

a second housing member having a plurality of contact cavities;

a plurality of male electrical contacts disposed in said contact cavities of said first housing member and having end means for coacting with corresponding contacts disposed in said second housing member;

a plurality of female electrical contacts disposed in said contact cavities of said second housing member and having a plurality of spring fingers for coating with said coacting end means of corresponding ones of said plurality of male contacts by being biased outwardly therefrom to develop and store a resilient force; and means associated with said first and second housing members and operable for securing said first housing member in mated combination with said second housing member;

said securing means causing said coacting end means of said plurality of male electrical contacts to mechanically and electrically engage said plurality of spring fingers of said plurality of female electrical contacts and to bias said plurality of spring fingers outwardly therefrom to develop and store said resilient force therein;

said resilient force stored in said plurality of spring fingers of said of female electrical contacts coacting against said coacting end means of said plurality of male electrical contacts upon release of said securing means to automatically demate said pluralities of male and female electrical contacts and to automatically separate said first and second housing members with zero separation force.

2. The zero separation force electrical connector of claim 1 wherein said securing means includes:

said first housing member having a threaded bore formed therein;

said second housing member having a bore formed therethrough; and a screw configured to be inserted through said bore formed through said second housing member and threaded into said threaded bore formed in said first housing member to mate said second housing member in combination with said first housing member.

3. The zero separation force electrical connector of claim 1 further including:

a shaped member depending outwardly from said first housing member; and said second housing member having a complementary shaped cavity configured to receive said shaped member;

said shaped member coacting with said complementary shaped cavity to align said first and second housing members for mating in combination.

4. The zero separation force electrical connector of claim 1 wherein each female contact of said plurality of female contacts has an open-ended socket configuration and wherein said plurality of spring fingers of each female contact are integrally formed from said socket configuration and extend inwardly therefrom.

5. The zero separation force electrical connector of claim 1 wherein said coacting end means of each said male contact is a tapered end.

6. The zero separation force electrical connector of claim 5 wherein each said tapered end of said male contacts is a conical end.

7. The zero separation force electrical connector of claim 1 wherein said end means of each said plurality of male electrical contacts includes a ramp surface and wherein each female contact of said plurality of female contacts has a single spring finger coacting with said ramp surface of said corresponding male contact by being biased outwardly therefrom to develop and store said resilient force.

8. The zero separation force electrical connector of claim 7 wherein each female contact has an open-ended socket configuration and wherein said single spring finger of each female contact is integrally formed from said socket configuration and extends inwardly therefrom.

9. A zero separation force electrical connector for mating with an electronic device, the electronic device including an externally projecting grid array of contact elements defining a first set of contact elements, comprising:

a housing member having a plurality of contact cavities;

a plurality of electrical contacts defining a second set of contact elements disposed in said contact cavities of said housing member and having means for coacting with the contacts elements of the externally projecting grid array of the electronic device to develop and store a resilient force; and means associated with said housing member and the electronic device and operable for securing said housing member in mated combination with the electronic device;

said securing means causing coacting means of said plurality of electrical contacts to mechanically and electrically engage the contact elements of the externally projecting grid array to develop and store said resilient force;

said stored resilient force providing for automatic demating between said plurality of electrical contacts and the contact elements of the externally projecting grid array and automatic zero force separation of said housing member from the electronic device upon release of said securing means;

one of the first and second sets of contact elements being female contacts having a plurality of spring fingers and the other of the first and second sets of contact elements being male contacts having end portions wherein end portions of the male contacts mechanically and electrically engage corresponding ones of the said plurality of spring fingers to bias the plurality of spring fingers outwardly therefrom to develop and store said resilient force.

10. The zero separation force electrical connector of claim 9 wherein said second set of contact elements are female contacts and wherein said coacting means of each said female contact is said plurality of spring fingers.

11. The zero separation force electrical connector of claim 9 wherein said securing means comprises:

said housing member having a bore formed therethrough; and a screw configured for insertion through said bore formed through said housing member;

said screw threadingly engaging a threaded inset in the electronic device to mate said housing member in combination with the electronic device.

12. The zero separation force electrical connector of claim 9 wherein each female contact has an open-ended socket configuration and wherein said plurality of spring fingers of each female contact are integrally formed from said socket configuration and extend inwardly therefrom.

13. The zero separation force electrical connector of claim 9 wherein said end portions of each male contact includes a ramp surface and wherein each female contact has a single spring finger coacting with said ramp surface of said corresponding male contact by being biased outwardly therefrom to develop and store said resilient force.

14. The zero separation force electrical connector of claim 13 wherein each female contact has an open-ended socket configuration and wherein said single spring finger of each female contact is integrally formed from said socket configuration and extends inwardly therefrom.

* * * * *